US005893251A

United States Patent [19]

Lund-Hansen

[11] Patent Number: 5,893,251

[45] Date of Patent: Apr. 13, 1999

[54] LAMELLA OR PANEL ELEMENT

[76] Inventor: Kjeld Balslev Lund-Hansen, Krajbjergvej 3, DK-8541 Sködstrup, Denmark

[21] Appl. No.: 08/884,139

[22] Filed: Jun. 27, 1997

Related U.S. Application Data

[62] Division of application No. 08/504,667, Jul. 20, 1995, Pat. No. 5,642,564, which is a continuation of application No. 08/245,471, May 18, 1994, abandoned, which is a continuation of application No. 07/689,780, Jun. 28, 1991, abandoned.

[30] Foreign Application Priority Data

Nov. 17, 1988 [DK] Denmark ..... 6410/88

[51] Int. Cl.[6] ..... E04B 2/00

[52] U.S. Cl. ..... 52/588.1; 52/584.1; 52/461

[58] Field of Search ..... 29/897.32, 525.01, 29/525.08; 52/459, 460, 461, 580, 581, 584.1, 588.1, 589.1, 592.1, 239, 238.1, 240, 242, 741.1, 745.19

[56] References Cited

U.S. PATENT DOCUMENTS

| | | | |
|---|---|---|---|
| 1,913,342 | 6/1933 | Schaffert | 52/588.1 |
| 2,103,407 | 12/1937 | Dean | 52/461 |
| 3,119,173 | 1/1964 | Glaser | 29/897.32 |
| 3,789,567 | 2/1974 | Rae et al. | 52/584.1 |
| 4,104,837 | 8/1978 | Naito | 52/588.1 |
| 4,635,422 | 1/1987 | Nowack et al. | 52/461 |
| 5,033,147 | 7/1991 | Svensson | 52/588.1 |
| 5,491,943 | 2/1996 | Vondrejs et al. | 52/239 |
| 5,642,564 | 7/1997 | Lund-Hansen | 29/897.32 |
| 5,647,184 | 7/1997 | Davis | 52/592.1 |
| 5,651,154 | 7/1997 | Ahlskog et al. | 52/588.1 |
| 5,782,044 | 7/1998 | Dodd et al. | 52/592.1 |

FOREIGN PATENT DOCUMENTS

| | | | |
|---|---|---|---|
| 487704 | 6/1952 | Canada | 52/584.1 |
| 422082 | 6/1948 | Italy | 52/584.1 |
| 2126106 | 3/1984 | United Kingdom | 52/588.1 |

*Primary Examiner*—David P. Bryant
*Attorney, Agent, or Firm*—Antonelli, Terry, Stout & Kraus, LLP

[57] ABSTRACT

A lamella or panel element and a method of making the same wherein plate profiles are provided along joining edges with cross flanges which, when the profiles are brought together edge to edge, engage each other in an interlocking manner in a transverse direction. The flange portions are locked together by inserting a U-shaped or C-shaped profiled joining member which engages the outside of the flange portions on the side edges with a loose fit. The joining member may be inserted manually and extend over the length of the profiles and, the despite the loose fit, it is nevertheless possible to achieve a strong and tight joining since the long profiles do not extend totally rectilinearly. The joining members are arranged inside cavities of the plate profiles so that the joint members are invisible thereby resulting in advantageously obtaining an entirely smooth surface in the joining areas between the respective plate profiles.

11 Claims, 2 Drawing Sheets

LAMELLA OR PANEL ELEMENT

This is a Divisional Application of U.S. Ser. No. 08/504,667, filed Jul. 20, 1995, now U.S. Pat. No. 5,642,564 which is a Continuation Application of U.S. Ser. No. 08/245,471 filed on May 18, 1994, now abandoned which also is a Continuation Application of U.S. Ser. No. 07/689,780 filed on Jun. 28, 1991 now abandoned.

FIELD OF THE INVENTION

A method of joining stiff plate profile members into broad lamellae or panels and a lamella or panel element or product produced by that method.

BACKGROUND OF THE INVENTION

The present invention relates to a method of joining hollow, extruded profiled plate lengths for the formation of broad lamellae or panels, broad lamella constructions for sun shading systems.

For certain applications, for example for broad lamellae in sun shading systems, it would be desirable to make use of flat and broad, hollow profiles of extruded aluminum, but as well known it is difficult and expensive to produce such extrusions with a width exceeding some 30 cm. Of course it is possible to join such profiles edgewise, by, for example use of joining fishes or by welding, but these methods are both expensive and unsuitable, as the ideal is to produce a reasonably smooth and uniform surface on the assembled. lamella.

An immediately more attractive solution has already been proposed, namely to take advantage of the extrusion technique to the effect that the single profile plates are manufactured with tongue-and-groove-systems along the edges, such that the profiles can be joined by a lengthwise pushing together. It has been found, however, that such a joining method, which may well be realistic in connection with profile elements of short lengths, is not realistic when the length of the profiles is of the magnitude 5 m, e.g. 3–7 m. The long profile elements will have to be reasonably stiff, and even though they are produced with all care they will, however, inevitably come up with such minor wrynesses over the long length which may not be visible at all, but in connection with the stiffness of the elements make it almost impossible to use the joining by a pushing together of the elements. The engagement portions could well be shaped with suitable tolerances, but the result would be that a few elements could be joined in an easy manner for obtaining a fixed joining, while the joinings between many other elements would not be fixed, which is entirely unacceptable. In many other cases an already initiated pushing-together joining would have to be stopped, e.g. upon three fourths of the joining movement having been carried out. Possibly many of the latter joinings could be accomplished anyway by an extra strong pressing together, but this will require a quite costly pressing equipment, and there would be considerable risks of skewnesses occurring in the joined structure.

According to another known and used technique advantage is still taken of the extrusion technique, namely, by shaping the profiles with complementary, barbed clamp surface portions, which can be brought into mutual engagement by a crosswise pressing together of the elements, such that the pressing movement shall be effected over a short distance only, but it is well known that this technique presents many problems as well as a rather high percentage of waste.

SUMMARY OF THE INVENTION

It is the purpose of the invention to provide a joining method, which can be effected in a simple and cheap manner for production of rigid joints with little if any waste.

According to the invention use is made of profile elements, the edge portions of which are shaped with interfacing engagement profile portions, which at each edge portion are provided on flange means projecting inwardly from the opposed other sides of the profile element with a free distance between the opposed engagement profile portions, with these portions being shaped such that, by a laying together of the profile elements edge to edge, they will interlock these elements in the transverse direction. The engagement profile portions are provided on flange means, which have a widening inside the profile element, such that, in their laid together condition, they will show a bilaterally widened head portion. For with these head portions thus being located opposite to each other with a free space therebetween for the joining of the profile elements is used an extra profile member shaped as a narrow plate strip, the opposed edges of which are provided with part-cylindrical flange portions of such cross sectional shapes that these flange portions, by an insertion of the extra profile member along the laid together engagement profile portions, can engage over the widened head portions so as to hold. these together. Thus, it is sufficient to lay together the profile elements edge to edge and then push in the extra joining profile member for holding together the head portions consisting of the respective halves of the inwardly projecting flange means, such that the profile elements are hereby interiorly interlocked.

It is important that the extra joining profile member is not a thick block string, but a plate strip with part-cylindrical widenings along the outer edges, because this will be decisive for this profile member being to some degree flexible, such that when it is inserted it may adapt itself to a slightly curved run of the laid together edge portions of the plate profile elements, should such a run occur.

The outwardly open part-cylindrical flange portions of the joining profile member may well be designed with a certain oversize relative to the flange head portions which they shall surround. For a joint over a short length this will result in an undesired loose joint, but, when the joint is pronounced elongated and shows even the slightest deviations from an accurately linear shape, then the part-cylindrical flange portions will at least at places hold the edges of plate profile elements, tightly joined, whereby these elements as respective wholes, will engage each other in an entirely stable manner.

By practical experiments with commercially produced profile elements of aluminum it has been found that it is hereby possible to provide a completely firm edge joining between profile elements having a length of 6 meters by a quite untroubled, manual insertion of the joining profile members.

BRIEF DESCRIPTION OF THE DRAWINGS

The invention, which is defined in the appended claims, is described in more detail in the following with reference to the drawing, wherein:

DETAILED DESCRIPTION

Figure 1:
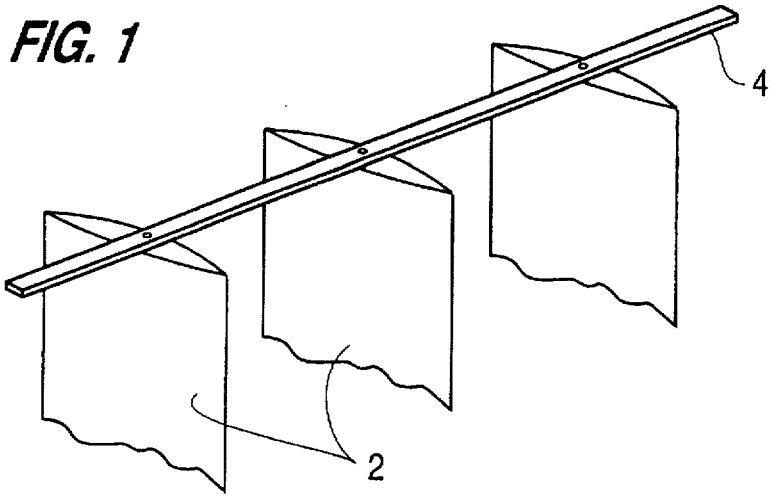
FIG. 1 is a perspective view of a few lamellae in a sun shading system.

FIG. 1 is shown the upper ends of a few laminae 2 which are mounted in a rotatable manner between an upper supporting beam 4 and a corresponding lower beam or box (not shown), in which means may be provided for concurrent turning of all the laminae for changing the angular positions thereof it can be as it can be desirable in a sun shading system. What is here concerned is heavy, large laminae with a width of, for example, 40–80 cm and with a length of some 2–8 meters. As these elements should be able to resist quite heavy wind forces and even other influences, they should be designed so as to be very stiff, and moreover they should be as light as possible. Also, their outer surfaces should be smooth. It could be close to hand to think of the elements as extruded aluminum profiles, but when their width is more than some 30 cm this is not an attractive possibility, while it is almost a practical impossibility if the width is 60 cm or more.

Figure 2:
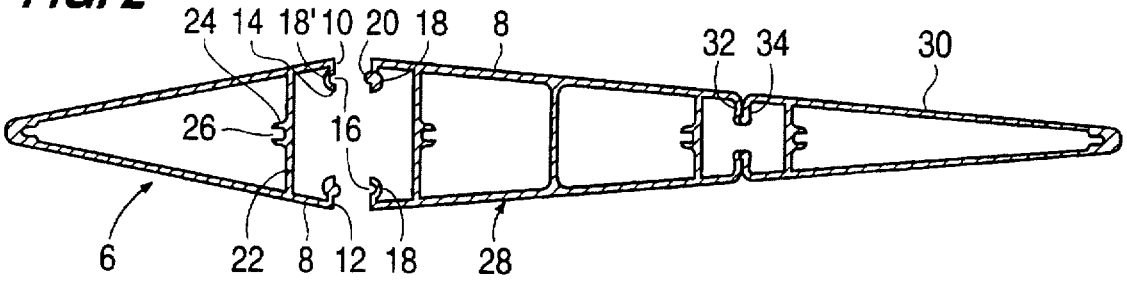
FIG. 2 is a sectional view of some adjoining profile elements for forming such lamellae.

As mentioned, therefore, it may be desirable to assemble the lamellae by edge joining of extruded profile elements, and in FIG. 2 provides an example of such profiles, which are ready to be joined edge to edge. Outermost to the left is shown a V-shaped profile element 6, which at each of its opposed free edges of the side walls 8 is shaped with flange portions 10 and 12 projecting inwardly towards each other. Along its free edge the flange 10 is shaped with a flange receiving cross sectionally half-circular portion 14 having a groove 16 opening towards the right and an opposed outer side 18 of a part-circular configuration concentric with the groove 16. At its rear side the other flange portion 12 has a quite similar part-circular widening, or flange portion 18', while at its front side it has forwardly projecting widening or rib portion 20 with a half-cylindrical cross section corresponding to the shape of the groove 16. At some distance inside its open end the V-profile element 6 is provided with a cross wall 22 having a projecting middle rib 24 shaped with a channel portion 26. Due to the cross wall 22 the profile element 6 will be a stiff hollow profile element.

Next to the profile element 6 is placed another profile element 28, of a trapezoidal shape, with the outer walls 8 and with cross walls 22. At its left hand end it is shaped exactly as a counterpart to the edge area of the profile element 6, i.e. with the flange portions 12,18', rib portion 20 located next to the half annular portion 14 and groove 16 of the profile element 6 and with its own half circular groove 16 located next to the flange portion 12 and rib portion 20 of the profile element 6. At its opposite, right hand end the profile element 28 is shaped in a manner corresponding to the profile element 6, though in the example illustrated with a somewhat smaller distance between the opposed flange portions 14,16 and 18',20.

To the right of the profile element 28 is placed a further profile element 30, which is shaped fully similarly to the profile, only with a smaller width at its open edge, corresponding to the reduced edge width of the right hand end of the profile element 28. The profile 30 is oriented such that the profile flange portions are located in a manner quite similar to their location at the left hand edge of the profile element 28.

The profile element 28 and 30 are shown entirely laid together, with the rib portions 20 received in the grooves 16 by a purely transversely oriented pushing together of the profile elements 28,30. Thereby the profile elements 28,30 will engage each other lockingly in the transverse direction perpendicular to the pushing together direction. The radius of the rib portions 20 is slightly less than the radius of the groove 16, such that the relevant, respective engagements can be established along the entire length of the profile elements, also when the lengthwise direction of the edge portions is not linear in any absolute sense. It will be noted that the laid together profile flange portions will appear as inwardly protruding ribs 32 having circular-cylindrical widenings or heads 34 formed by the surface portions 18 and 18' on the flanges to be joined.

Figure 3:
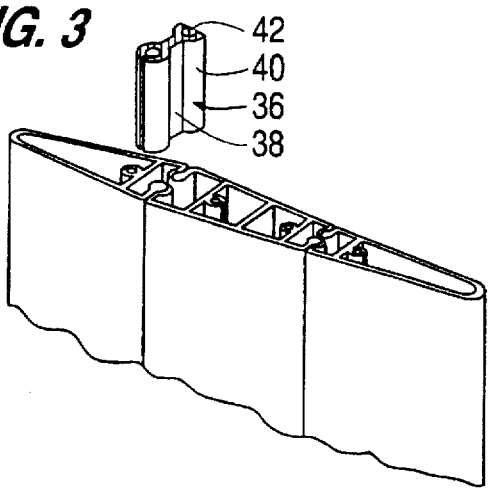
FIG. 3 is an exploded perspective view thereof.

As illustrated in FIG. 3 it is possible to thereafter lock together the portions foring the head portions 34, namely by inserting a locking profile member 36 over and along these head portions 34. The profile member 36 comprises an intermediate plate strip portion 38, the opposed longitudinal edges of which are provided with outwardly open, part-cylindrical flanges 40, which are adapted to surround the head portions 34, such that, by the insertion of the locking profile 36, the laid together, head forming parts will be totally interlocked by their local engagement with the closely surrounding profile portions 40.

However, it is here very important that the local locking engagement should not be 'total' in each single cross section of the structure, as the inner diameter of the part cylindrical recess 42 in the flange portions 40 is slightly larger than the outer diameter of the head portions 34, e.g. with the ratio 4.5:4.0 mm. Purely locally, i.e. in each single cross section, this will be highly unacceptable, since even the slightest play in the joint will be inadmissible, but as already mentioned the circumstances are different when very long elements are to be joined. These will inevitably show small inaccuracies in their length directions, and by the insertion of the joining member 36 the overdimensioning will account for the advantageous effect that the joining member 36 is very easy to insert, preferably purely manually, and yet it will serve to establish a 'total' holding engagement at just some places along the entire length of the elements, this being sufficient to produce an entirely stiff joining of the respective neighboring profile elements 6, 28 and 30.

Figure 4:
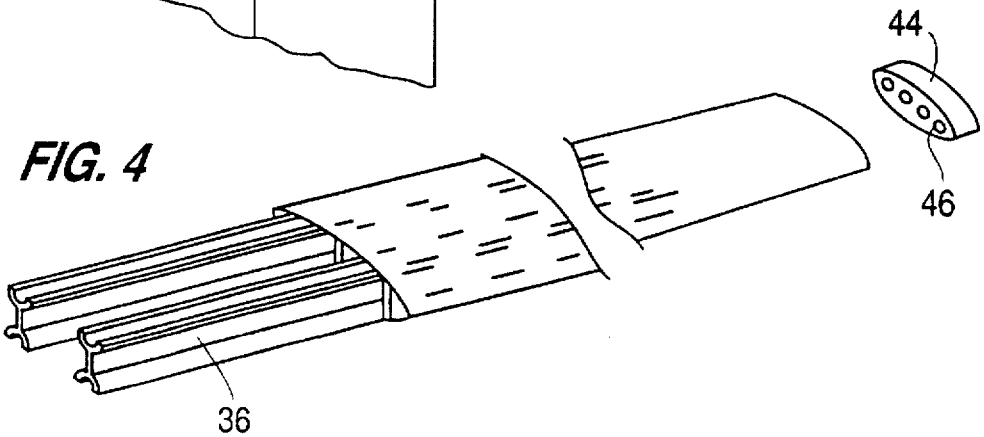
FIG. 4 is an exploded perspective view of a lamella when being assembled.

In FIG. 4 it is illustrated how the joining profile members 36 are inserted along the entire length of the. edgewise joined plate profile elements 6, 28 and 30, and it should be noted that the lengths in question may be e.g. 2–8 meters, which are relatively high lengths. In FIG. 4 it is also shown that the ends of the joined profile elements may be covered by an end plate 44, in which holes 46 are provided for receiving bolts to be screwed into the ends of the hollow flange portions 24,26 on the cross walls 22 of the profiled elements, and if the use of pivot pins is desired such pins may be connected with these end plates.

The invention is not limited to the production of sun shading lamellae, as it may be applied generally wherever it is desired to join relatively narrow profile elements into broader lamella or panel structures. It will be appreciated that based on the profile elements shown in FIG. 2 it is possible to build up other lamella configurations, e.g. relatively narrow profiles by joining two elements 30 directly edge to edge or with use of two intermediate profiles 28, which are interconnected at their broad ends and are furthermore joined with end profiles 30 at both ends or edges.

Figure 5:
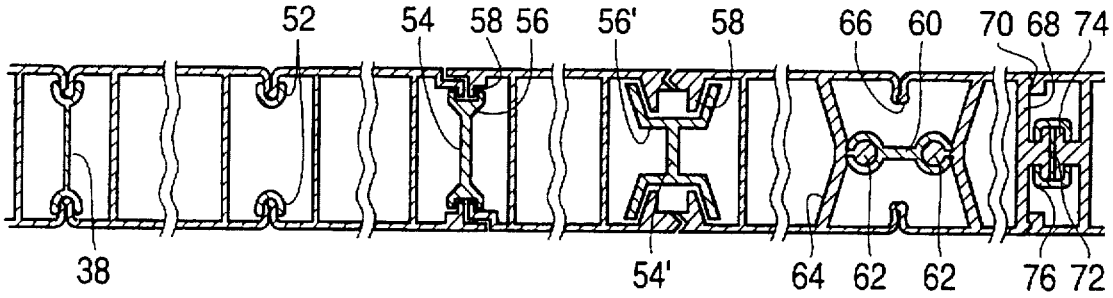
FIG. 5 is a sectional view of a panel element according to the invention.
Figure 6:
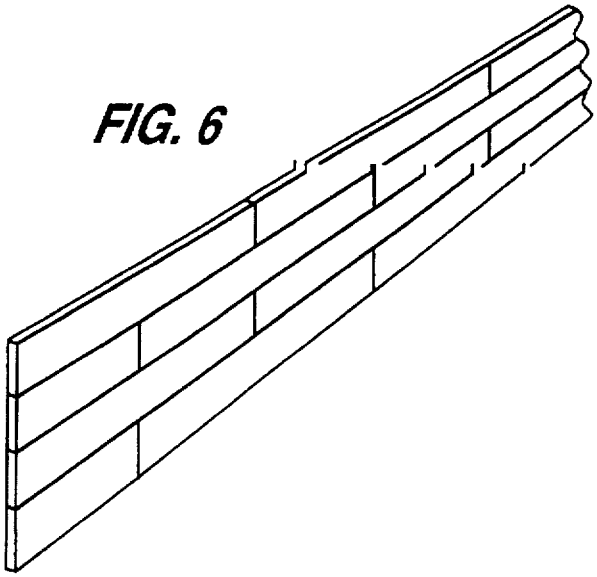
FIGS. 6 and 7 are perspective views of structures provided in accordance with the invention.
Figure 7:
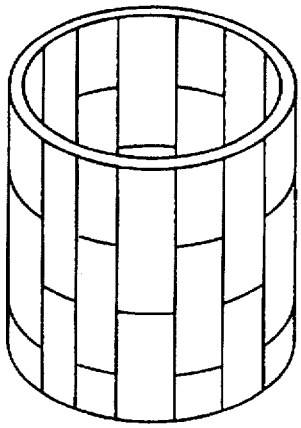

In FIG. 5 it is indicated that in a corresponding manner it is possible to join profile elements 50 having plan parallel outer sides into a structure having an unrestricted dimension in the cross direction, e.g. for the construction of very broad panel elements. It is also shown that the joining profiles 36 may be modified in various ways, e.g. in being replaced by singular embracing profiles 52 for the respective head portions 34, with the cross connection 38 between these profile portions being less important when fixed cross walls 22 are already present adjacent the joining areas, as these walls will hold together the edge portions of the profile elements with the desired spacing.

The joining profile portions 40 should not necessarily extend over more than 180°, as their primary function is to merely hold the head forming portions 34 together, against each other in the width direction of the assembled structure, while the holding together in the cross direction will be effected by the cross wall portions 22 of the profile elements. An example of this is shown in FIG. 5, where a connector profile 54 having U-shaped edge flanges 56 cooperates with inwardly protruding plate flanges 58 next to the edges of the profile elements, which are otherwise joined by an ordinary socket joint. At the right hand side of this joint another joint is shown, where the flanges 58' are mutually spaced, but held together by a correspondingly broader joining head 56' on the joining profile 54'; such a broad joining head, however, is not particularly advantageous, as it causes an increased stiffness of the joining profile, whereby the latter can less easily adapt itself to the slightly cured shape of the profile elements, whereby it may be more difficult to insert.

As shown in FIG. 5, a joining profile element 60 may extend in the plane of the profile elements and serve to hold together such portions 62 which are projections on the edge walls 64 of the profile elements, whereby the outer edge areas will be held together at interengaging flange portions 66. At the outer right hand side of FIG. 5 another modification is shown, where the profile elements at one side do not have any edge recess, but are terminated by an end wall 68, along the edges of which there are provided engagement ribs 70 for guidingly receiving the side edges of the neighboring element. Between the opposed edge ribs 70 the edge wall 68 is at one or more places provided with a projecting T-profiled portion 72, which is held together with a corresponding profile portion 74 on the neighboring element by joining profiles 76.

It should be mentioned that the use of the joining profiles, when these are inserted with considerable force for straightening the slight wryness of the elements, will act strongly reinforcing on the elements, whereby it will often be possible to make use of a thinner base material.

The elements can be surface treated before the joining, whereby no after treatment will be needed.

I claim:

1. A lamella structure comprising:

a plurality of profile elements, each having a hollow body with opposed side walls ending in parallel profiled ends, the parallel profiled ends of the opposed side walls each having an outer side and an inner side, the inner sides of the profiled ends of the opposed side walls of each profile element facing each other and each having a projection portion projecting towards the corresponding projection portion of the opposed side wall, the profiled ends and the projection portions of the respective side walls of each profile element cooperating to provide respective tongue and groove portions adapted to abut the respective tongue and groove portions of another of said profile elements; and a profiled joining element having opposed joining heads and a connector web connecting the joining heads, each joining head having an outwardly open groove adapted to receive the projection portions of two abutting profile elements to join the two profile elements end to end with the joining head grooves cooperating with the profile element projection portions to laterally stabilize the abutting profile elements.

2. A lamella structure according to claim 1, wherein:

each projection portion of each profile element has an outer side and an inner side, the outer sides being adapted to face and abut the outer sides of a projection portion of another profile element when the profile elements are abutting end to end;

the grooves of the joining element are adapted to receive the facing projection portions; and the outer sides of the projection portions form part of the profiled ends of the side walls and have the tongue and groove elements formed therein.

3. A lamella structure according to claim 2, wherein the tongue and groove portions have a rounded cross sectional shape.

4. A lamella structure according to claim 2, wherein the inner sides of the projection portions are profiled with a substantially half circular configuration to form a substantially circular head portion when two profile elements are abutting, and wherein the joining element grooves are C-shaped to accommodate the circular head portions.

5. A lamella structure according to claim 1, wherein the outer sides of the side walls of the hollow profile elements extend in a substantially smooth surface.

6. A lamella structure according to claim 5, wherein the outer sides of the side walls of the hollow profile elements extend in a substantially straight plane.

7. A lamella structure according to claim 5, wherein the outer sides of the side walls on the hollow profile elements extend in a curved surface.

8. A lamella structure according to any of the preceding claims, wherein the hollow profile elements are extrusions made of aluminum, and wherein the grooves of the profiled joining element have an interior width slightly the grooves of the profiled joining element have an interior width slightly greater than the exterior width of the projection portions of two abutting profile elements when the two profile elements are joined by the profiled joining element.

9. A structure according to claim 8, wherein the profiled joining element is made of aluminum, and wherein the connector web of the profiled joining element has a thickness less than the width of the joining heads.

10. A lamella structure comprising:

first and second profile elements, each having a hollow body with opposed side walls having parallel profiled first ends and pointed second ends, the parallel profiled first ends of the opposed side walls each having an outer side and an inner side, the inner sides of the first ends of the opposed side walls facing each other and each having a projection portion projecting towards the corresponding projection portion of the opposed side wall, the parallel profiled first ends and the projection portions of the respective side walls of each of the first and second profile elements cooperating to provide respective tongue and groove portions;

a third profile element having a hollow body with opposed side walls ending in parallel profiled first ends and parallel profiled second ends, the parallel profiled first and second ends of said opposed side walls each having an outer side and an inner side, the inner sides of the profiled ends of the opposed side walls facing each other and each having a projection portion projecting towards the corresponding projection portion of the opposed side wall, the parallel profiled first and second ends and the projection portions of the respective side walls of the third profile element cooperating to provide respective tongue and groove portions adapted to abut the respective tongue and groove portions of the profiled ends of another profile element; and first and second profiled joining elements, each having opposed joining heads and a connector web connecting the joining heads, each joining head having an outwardly open groove, the grooves of the joining heads of the first profiled joining element receiving the projection portions of the profiled ends of the two side walls of the first profile element and the projections portions of the first profiled ends of the two side walls of the third profile element to join the first and third profile elements end to end with the joining head grooves cooperating with the projection portions to laterally stabilize the abutting first and third profile elements, and the grooves of the joining heads of the second profiled joining element receiving the projection portions of the profiled ends of the two side walls of the second profile element and the projections portions of the first profiled ends of the two side walls of the third profile element to join the second and third profile elements end to end with the joining head grooves cooperating with the projection portions to laterally stabilize the abutting second and third profile elements.

11. A lamella structure according claim 10, wherein the hollow profile elements are extrusions made of aluminum, and wherein the grooves of the profiled joining element have an interior width slightly greater than the exterior width of the projection portions of two abutting profile elements when the two profile elements are joined by the profiled joining element.

* * * * *